US009466883B2

(12) United States Patent
Li

(10) Patent No.: US 9,466,883 B2
(45) Date of Patent: Oct. 11, 2016

(54) PRINTED ANTENNA AND MOBILE COMMUNICATION EQUIPMENT

(75) Inventor: Meng Li, Shenzhen (CN)

(73) Assignee: ZTE CORPORATION, Shenzhen (CN)

( * ) Notice: Subject to any disclaimer, the term of this patent is extended or adjusted under 35 U.S.C. 154(b) by 173 days.

(21) Appl. No.: 14/348,663

(22) PCT Filed: Dec. 31, 2011

(86) PCT No.: PCT/CN2011/085133

§ 371 (c)(1),
(2), (4) Date: Mar. 31, 2014

(87) PCT Pub. No.: WO2013/044573

PCT Pub. Date: Apr. 4, 2013

(65) Prior Publication Data

US 2014/0225784 A1 Aug. 14, 2014

(30) Foreign Application Priority Data

Sep. 30, 2011 (CN) ..... 2011 2 0372894 U

(51) Int. Cl.

| | |
|---|---|
| ***H01Q 1/38*** | (2006.01) |
| ***H01Q 9/04*** | (2006.01) |
| ***H01Q 1/24*** | (2006.01) |
| ***H01Q 1/48*** | (2006.01) |
| ***H01Q 5/364*** | (2015.01) |

(52) U.S. Cl.

CPC ..... *H01Q 9/0407* (2013.01); *H01Q 1/243* (2013.01); *H01Q 1/38* (2013.01); *H01Q 1/48* (2013.01); *H01Q 5/364* (2015.01); *H01Q 9/0442* (2013.01)

(58) Field of Classification Search

CPC ..... H01Q 1/38; H01Q 5/364; H01Q 9/0407

USPC ..... 343/700 MS, 702, 848, 846

See application file for complete search history.

(56) References Cited

U.S. PATENT DOCUMENTS

| | | | | |
|---|---|---|---|---|
| 2002/0190909 | A1 | 12/2002 | Yamamoto et al. | |
| 2004/0137950 | A1* | 7/2004 | Bolin | H01Q 1/243 455/562.1 |
| 2009/0289859 | A1* | 11/2009 | Pan | H01Q 1/243 343/702 |

(Continued)

FOREIGN PATENT DOCUMENTS

| | | |
|---|---|---|
| CN | 2579000 Y | 10/2003 |
| CN | 2684392 Y | 3/2005 |
| CN | 102132454 | 7/2011 |

OTHER PUBLICATIONS

International Search Report for corresponding application PCT/CN2011/085133 filed Jul. 5, 2012; Mail date Jul. 5, 2012.

*Primary Examiner* — Hoanganh Le
(74) *Attorney, Agent, or Firm* — Cantor Colburn LLP

(57) ABSTRACT

Disclosed is a printed antenna which includes: a ground plane which is a layer of metal formed on the insulating layer; a feed unit which is multiple metallic lines formed on the insulating layer and includes a first end and a second end; a feed point which is set between the feed unit and the ground plane and is connected to the first end of the feed unit; a first radiation unit which is formed on the insulating layer, and configured to radiate or receive first frequency band signals; a second radiation unit which is formed on the insulating layer, connected to the second end of the feed unit, and configured to radiate or receive second frequency band signals; a third radiation unit, which is formed on the insulating layer, connected to the second end of the feed unit, and configured to radiate or receive third frequency band signals.

12 Claims, 6 Drawing Sheets

(56) References Cited

U.S. PATENT DOCUMENTS

2010/0013714 A1 1/2010 Azhari
2010/0103069 A1* 4/2010 Wang ..... H01Q 1/243 343/846
2012/0076184 A1* 3/2012 Tran ..... H01Q 1/085 375/222
2012/0230377 A1* 9/2012 Jenwatanavet ..... H01Q 1/085 375/222

* cited by examiner

PRINTED ANTENNA AND MOBILE COMMUNICATION EQUIPMENT

TECHNICAL FIELD

The disclosure relates to a printed antenna and in particular to a printed antenna and mobile communication equipment.

BACKGROUND

With the development and popularization of mobile communication technologies, the mobile communication terminals are applied more and more, and any mobile communication terminal cannot leave without antennae, so antennae play a very important role in mobile communications.

Since the printed antenna that can be printed on a printed circuit board (PCB) has the following features: the structure is simple, the performance is good, the profile is low, and it can be integrated on the PCB easily, it is widely applied in terminal antennae.

In the existing printed antennae, antennae that can radiate dual-frequency, tri-frequency and multi-frequency have been used widely; however, in the relevant art, tri-frequency and even higher-frequency antennae require two or more feed points and also require additional switch circuits to control the two or more feed points; in other related arts, there is also the case where several single-frequency antennae are used to realize multi-band antennae, and in such arts, switch control circuits are used to control different single-frequency antennae to operate in different bands to obtain the effect of multi-frequency radiation.

In the above-mentioned related art, there are at least the following technical problems:

for a multi-band antenna with multiple feed points, since it is required to design a plurality of feed points, there is the technical problem whereby the structure is complicated and there are many feed points;

for the case where several single-frequency antennae are controlled with the switch control circuits, since it is required to add switch control circuits additionally and there are also a plurality of feed points, there is also the technical problem whereby the design is complicated, the structure is complicated and there are many feed points.

SUMMARY

The disclosure provides a printed antenna and mobile communication equipment, so as to solve the technical problem in the relevant art whereby the design is complicated and there are many feed points.

According to one aspect, an embodiment of the disclosure provides a printed antenna provided on a PCB with an insulating layer, the printed antenna comprising:

a ground plane, being a layer of metal formed on the insulating layer;

a feed unit, being multiple metallic lines formed on the insulating layer and including a first end and a second end;

a feed point, provided between the feed unit and the ground plane, and connected to the first end of the feed unit;

a first radiation unit, formed on the insulating layer, connected to the second end of the feed unit, and configured to radiate or receive first frequency band signals;

a second radiation unit, formed on the insulating layer, connected to the second end of the feed unit, and configured to radiate or receive second frequency band signals;

a third radiation unit, formed on the insulating layer, connected to the second end of the feed unit, and configured to radiate or receive third frequency band signals.

Preferably, a first area of the first radiation unit is greater than a second area of the second radiation unit and the second area is greater than a third area of the third radiation unit.

Preferably, the first radiation unit comprises:

a transverse arm, being a metallic layer formed on the insulating layer, and connected to the second end of the feed unit;

a first radiation subunit, being a metallic layer which extends upwards from the left end of the transverse arm and is formed on the insulating layer;

a second radiation subunit, being a metallic layer which extends upwards from the right end of the transverse arm and is formed above the insulating layer;

a third radiation subunit, being a metallic layer which extends upwards from the middle of the transverse arm and is formed on the insulating layer, the width of the third radiation subunit being greater than the widths of the first and the second radiation subunits;

a fourth radiation subunit, being a metallic layer which extends upwards from the transverse arm between the second radiation subunit and the third radiation subunit and is formed on the insulating layer, there being a gap between the fourth radiation subunit and the second radiation subunit and a gap between the fourth radiation subunit and the third radiation subunit;

a fifth radiation subunit, being a metallic layer which extends upwards from the transverse arm between the first radiation subunit and the third radiation subunit and is formed on the insulating layer, there being a gap between the fifth radiation subunit and the first radiation subunit and a gap between the fifth radiation subunit and the third radiation subunit, wherein the widths of the fourth and the fifth radiation subunits are smaller than the widths of the first and the second radiation subunits respectively;

a sixth radiation subunit, formed at the top of the third radiation subunit, the width of the sixth radiation subunit being greater than that the width of the third radiation subunit.

Preferably, the first area is composed of areas of the sixth, the first and the second radiation subunits and the transverse arm.

Preferably, the second radiation unit comprises:

the fourth and the fifth radiation subunits, wherein the second area is composed of areas of the fourth and the fifth radiation subunits and the transverse arm.

Preferably, the third radiation unit is in particular a third radiation subunit, the third area being an area of the third radiation subunit.

According to another aspect, an embodiment of the disclosure also provides another printed antenna provided on a PCB board with an insulating layer, the printed antenna comprising:

A ground plane, being a layer of metal formed on the insulating layer;

a feed unit, being multiple metallic lines formed on the insulating layer and including a first end and a second end;

a feed point, provided between the feed unit and the ground plane, and connected to the first end of the feed unit;

a first radiation unit, formed on the insulating layer, connected to the second end of the feed unit, and configured to radiate or receive first frequency band signals, wherein the first radiation unit comprises:

a transverse arm, being a metallic layer formed on the insulating layer, and connected to the second end of the feed unit;

a first radiation subunit, being a metallic layer which extends upwards from the left end of the transverse arm and is formed on the insulating layer;

a second radiation subunit, being a metallic layer which extends upwards from the right end of the transverse arm and is formed on the insulating layer;

a sixth radiation subunit, formed at the top of the third radiation subunit, the width of the sixth radiation subunit being greater than that the width of the third radiation subunit.

Preferably, the printed antenna further comprises:

a second radiation unit, formed on the insulating layer, connected to the second end of the feed unit, and configured to radiate or receive second frequency band signals;

a third radiation unit, formed on the insulating layer, connected to the second end of the feed unit, and configured to radiate or receive third frequency band signals.

Preferably, a first area of the first radiation unit is greater than a second area of the second radiation unit and the second area is greater than a third area of the third radiation unit.

Preferably, the second radiation unit comprises:

the transverse arm;

a fourth radiation subunit, being a metallic layer which extends upwards from the transverse arm between the second radiation subunit and the third radiation subunit and is formed on the insulating layer, there being a gap between the fourth radiation subunit and the second radiation subunit and a gap between the fourth radiation subunit and the third radiation subunit;

a fifth radiation subunit, being a metallic layer which extends upwards from the transverse arm between the first radiation subunit and the third radiation subunit and is formed on the insulating layer, there being a gap between the fifth radiation subunit and the first radiation subunit and a gap between the fifth radiation subunit and the third radiation subunit, wherein the widths of the fourth and the fifth radiation subunits are smaller than the widths of the first and the second radiation subunits respectively.

Preferably, the third radiation unit comprises:

the third radiation subunit, wherein the third radiation subunit is a metallic layer which extends upwards from the middle of the transverse arm and is formed on the insulating layer, the width of the third radiation subunit being greater than the widths of the first and the second radiation subunits respectively.

According to another aspect, an embodiment of the disclosure also provides mobile communication equipment, comprising:

a data input device configured to provide a user with input data;

a data output device configured to output data to a user;

a PCB comprising: an insulating layer;

a ground plane, being a layer of metal formed on the insulating layer;

a feed unit, being multiple metallic lines formed on the insulating layer and including a first end and a second end;

a feed point, provided between the feed unit and the ground plane, and connected to the first end of the feed unit;

a first radiation unit, formed on the insulating layer, connected to the second end of the feed unit, and configured to radiate or receive first frequency band signals;

a second radiation unit, formed on the insulating layer, connected to the second end of the feed unit, and configured to radiate or receive second frequency band signals;

a third radiation unit, formed on the insulating layer, connected to the second end of the feed unit, and configured to radiate or receive third frequency band signals.

Preferably, a first area of the first radiation unit is greater than a second area of the second radiation unit and the second area is greater than a third area of the third radiation unit.

One or more technical solutions in the embodiments of the disclosure at least have the following technical effects:

since the radiation units are completely embedded together, a single radiation source is formed. In addition, three kinds of frequencies can be radiated with one feed point;

since there is only one feed point in the entire antenna, it still has the advantages that the structure is simple and the operation is convenient; and since there is only one feed point in the entire antenna, mutual interference between the feed points can be prevented, ensuring the transmission performance of the antenna.

DETAILED DESCRIPTION OF THE EMBODIMENTS

In order to enable those skilled in the art to which the present application belongs understand the disclosure more clearly, the technical solution of the disclosure will be described in detail with particular embodiments in conjunction with the accompanying drawings hereinafter.

Figure 1:
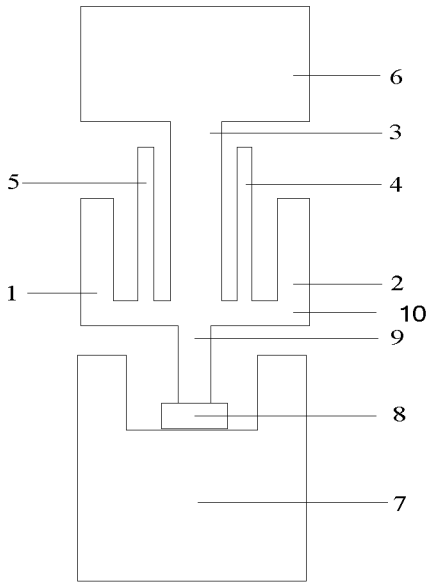
FIG. 1 is a structure diagram of a printed antenna in embodiment 1 of the disclosure.

On one hand, the first embodiment of the disclosure provides a printed antenna set on a PCB board with an insulating layer, the particular structure of the printed antenna is as shown in FIG. 1 and the printed antenna comprises:

a ground plane 7, a feed point 8, a feed unit 9, a transverse arm 10, a first radiation subunit 1, a second radiation subunit 2, a third radiation subunit 3, a fourth radiation subunit 4, a fifth radiation subunit 5 and a sixth radiation subunit 6.

The ground plane 7 is a layer of metal formed on the insulating layer, wherein the metal can be copper (Cu) or aluminum (Al) and may also be other metal or metal alloy with a small resistance and strong anti-interference capability known to those skilled in the art.

The feed unit 9 is multiple metallic lines formed on the insulating layer, and the feed unit 9 includes a first end and a second end, the material of the feed unit 9 may be the same as or different from that of the ground plane; the ground plane 7 may be located together with the feed unit 9 on the same side of the PCB board and they may be located on either side of the PCB board respectively.

The feed point 8 is set between the feed unit 9 and the ground plane 7, the feed point 8 is connected to the first end of the feed unit 9, and the feed point 8 feeds each radiation subunit via the feed unit 9.

The transverse arm 10 is a metallic layer formed on the insulating layer, the second end of the feed unit 9 is connected to the transverse arm 10, the connection position is approximately in the middle of the transverse arm 10, and during practical application, those skilled in the art to which the present application belongs can also set the connection position to be close to the left end or the right end of the transverse arm 10 as required. The metal which forms the transverse arm 10 may be Cu or other metal, and the metal which forms the transverse arm 10 can be the same as or different from the metal which forms the feed unit 9.

The first radiation subunit 1 is a metallic layer which extends upwards from the left end of the transverse arm and is formed on the insulating layer, and during the process of extending upwards to form the first radiation subunit 1, it may be extending upwards vertically and may also be extending upwards slightly to the left or to the right. The metal which forms the first radiation subunit 1 may be Cu or other metal, and the metal which forms the first radiation subunit 1 may be the same as or different from the metal which forms the feed unit 9.

The second radiation subunit 2 is a metallic layer which extends upwards from the right end of the transverse arm and is formed on the insulating layer, and during the process of extending upwards to form the second radiation subunit 2, it may be extending upwards vertically and may also be extending upwards slightly to the left or to the right. The metal which forms the second radiation subunit 2 may be Cu or other metal, and the metal which forms the second radiation subunit 2 may be the same as or different from the metal which forms the feed unit 9.

The third radiation subunit 3 is a metallic layer which extends upwards from the middle of the transverse arm and is formed on the insulating layer, and during the process of extending upwards to form the third radiation subunit 3, it may be extending upwards vertically and may also be extending upwards slightly to the left or to the right. The metal which forms the third radiation subunit 3 may be Cu or other metal, and the metal which forms the third radiation subunit 3 may be the same as or different from the metal which forms the feed unit 9, and the width of the third radiation subunit 3 is greater than the width of the first radiation subunit 1 and the width of the second radiation subunit 2 respectively.

The fourth radiation subunit 4 is a metallic layer which extends upwards from the transverse arm between the second radiation subunit 2 and the third radiation subunit 3 and is formed on the insulating layer, and during the process of extending upwards to form the fourth radiation subunit 4, it may be extending upwards vertically and may also be extending upwards slightly to the left or to the right. The metal which forms the fourth radiation subunit 4 may be Cu or other metal, and the metal which forms the fourth radiation subunit 4 may be the same as or different from the metal which forms the feed unit 9, and there is a first gap between the fourth radiation subunit 4 and the second radiation subunit 2, there is also a second gap between the fourth radiation subunit 4 and the third radiation subunit 3, the width of the first gap may be the same as or different from that of the second gap.

The fifth radiation subunit 5 is a metallic layer which extends upwards from the transverse arm between the first radiation subunit 1 and the third radiation subunit 3 and is formed on the insulating layer, and during the process of extending upwards to form the fifth radiation subunit 5, it may be extending upwards vertically and may also be extending upwards slightly to the left or to the right. The metal which forms the fifth radiation subunit 5 may be Cu or other metal, and the metal which forms the fifth radiation subunit 5 may be the same as or different from the metal which forms the feed unit 9, and there is a third gap between the fifth radiation subunit 5 and the first radiation subunit 1, there is also a fourth gap between the fifth radiation subunit 5 and the third radiation subunit 3, the width of the third gap may be the same as or different from that of the fourth gap.

The width of the fourth radiation subunit 4 and the width of the fifth radiation subunit 5 are smaller than those of the first radiation subunit 1 and the second radiation subunit 2 respectively;

the sixth radiation subunit 6 is formed on the top of the third radiation subunit 3, during the forming process, the top of the third radiation subunit 3 may be approximately connected to the middle of the lower edge of the six radiation subunit 6 and may also be connected to a position slightly to the left end or the right end on the lower edge of the sixth radiation subunit 6, and the metal which forms the sixth radiation subunit 6 may be Cu or other metal, and the metal which forms the sixth radiation subunit 6 may be the same as or different from the metal which forms the feed unit 9, and the width of the lower edge of the sixth radiation subunit 6 is greater than that the width of the top of the third radiation subunit 3.

The sixth radiation subunit 6, the first radiation subunit 1, the second radiation subunit 2 and the transverse arm 10 constitute a first radiation unit the area of which is the first area; the fourth radiation subunit 4, the fifth radiation subunit 5 and the transverse arm 10 constitute a second radiation unit the area of which is the second area; and the third radiation subunit 3 forms a third radiation unit, the area of the third radiation unit is the third area, wherein the first area is greater than the second area, and the second area is greater than the third area.

During the operation of the antenna, since the areas of the first area, the second area and the third area are different, three kinds of signals in different frequency bands are radiated via the first, the second and the third radiation units, and in particular, the energy radiated by the first radiation unit is low-frequency energy, the frequency range thereof may be 870 MHz to 975 MHz, of course, low-frequency signals in other frequency band may also be radiated; the energy radiated by the second radiation unit is intermediate-frequency energy, the frequency range thereof may be 1.7 GHz to 2 GHz, of course, intermediate-frequency signals in other frequency band may also be radiated; the energy radiated by the third radiation unit is high-frequency energy, the frequency range thereof may be 2.2 GHz to 2.8 GHz, of course, high-frequency signals in other frequency band may also be radiated.

Of course, the low frequency, intermediate-frequency and high-frequency resonate frequencies in this embodiment 1 may be adjusted by adjusting the size of the gap between the fourth radiation subunit 4 and the second radiation subunit 2 and the size of the gap between fourth radiation subunit 4 and the third radiation subunit 3, and adjusting the size of the gap between the fifth radiation subunit 5 and the first radiation subunit 1 and the size of the gap between the fifth radiation subunit 5 and the third radiation subunit 3; by adjusting the width of the feed unit 9 and the size and shape of the ground plane 7, the standing wave parameters and radiation direction of the antenna in embodiment 1 of the disclosure may be adjusted.

Figure 2:
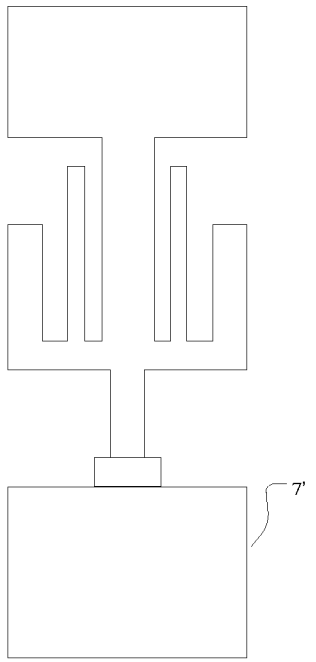
FIG. 2 is a structure diagram of a printed antenna in embodiment 2 of the disclosure.

Please refer to FIG. 2, it is a printed antenna provided in the second embodiment of the disclosure, and in the second embodiment, the shape of the ground plane 7' is different from that of the ground plane 7 in the first embodiment, and in the first embodiment, the two ends of the upper edge of the ground plane 7 also extend upwards to form two arms, but neither of these two arms is connected to the transverse arm 10, while in the second embodiment, the two ends of the upper edge of the ground plane 7' do not extend upwards to form two arms.

Figure 3:
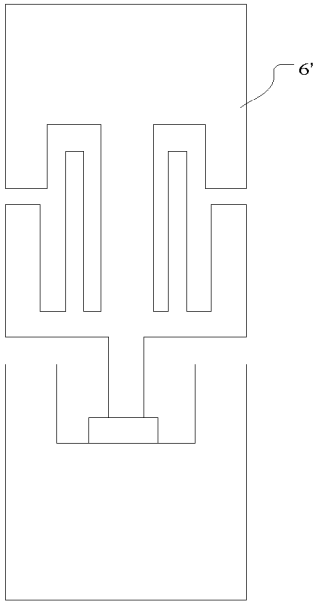
FIG. 3 is a structure diagram of a printed antenna in embodiment 3 of the disclosure.

Please refer to FIG. 3, it is a printed antenna provided in the third embodiment of the disclosure, in the third embodiment, the shape of the sixth radiation subunit 6' is different from that of the sixth radiation subunit 6 in the first embodiment, and in the third embodiment, the two ends of the lower edge of the sixth radiation subunit 6' also extend downwards to form two arms, but neither of these two arms is connected to the first radiation subunit 1, the second radiation subunit 2, the fourth radiation subunit 4 and the fifth radiation subunit 5.

Of course, for those skilled in the art to which the present application belongs, the printed antenna may have various changes and variations according to the actual demand; however, as long as the variations thereof may finally realize there are three different frequency bands and there is only one feed point, those amendments within the disclosure are all included in the scope of the protection of the disclosure.

On the other hand, a fourth embodiment of the disclosure provides a printed circuit board, which comprises:

an insulating layer;

a ground plane being a layer of metal formed on the insulating layer;

a feed unit being multiple metallic lines formed on the insulating layer and including a first end and a second end;

a feed point set between the feed unit and the ground plane, and connected to the first end of the feed unit;

a first radiation unit, formed on the insulating layer, connected to the second end of the feed unit, and configured to radiate or receive first frequency band signals;

a second radiation unit, formed on the insulating layer, connected to the second end of the feed unit, and configured to radiate or receive second frequency band signals;

a third radiation unit, formed on the insulating layer, connected to the second end of the feed unit, and configured to radiate or receive third frequency band signals.

Figure 4:
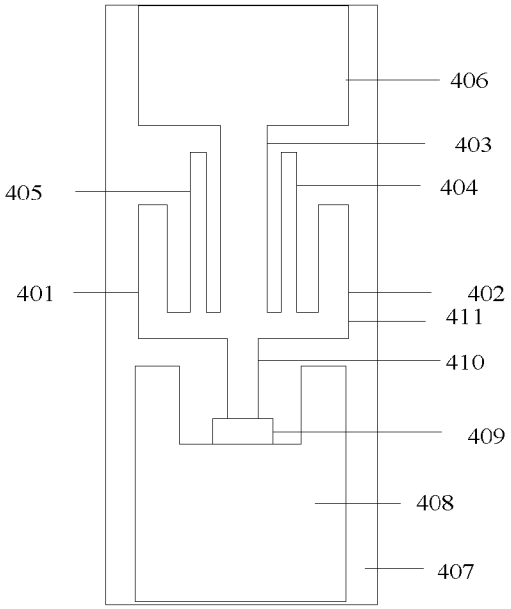
FIG. 4 is a structure diagram of a printed antenna in embodiment 4 of the disclosure.

Referring to FIG. 4, the structure of a printed circuit board in this embodiment is as follows:

an insulating layer 407;

a ground plane 408 is a layer of metal formed on the insulating layer 407, wherein the metal may be Cu or Al and may also be other metal or metal alloy with a small resistance and strong anti-interference capability known to those skilled in the art;

A feed unit 410 is multiple metallic lines formed on the insulating layer 407, and includes a first end and a second end, wherein the material of the feed unit 410 may be the same as or different from that of the ground plane 408; the ground plane 408 may be located together with the feed unit 410 on the same side of the PCB board and they may be located on either side of the PCB board respectively.

A feed point 409 is set between the feed unit 410 and the ground plane 408, wherein the feed point 409 is connected to the first end of the feed unit 410, and the feed point 409 feeds each radiation subunit via the feed unit 410.

A transverse arm 411 is a metallic layer formed on the insulating layer 407, wherein the second end of the feed unit 410 is connected to the transverse arm 411, the connection position is approximately in the middle of the transverse arm 411. During practical application, those skilled in the art to which the present application belongs may also set the connection position to be close to the left end or the right end of the transverse arm 411 as required. The metal which forms the transverse arm 411 may be Cu or other metal, and the metal which forms the transverse arm 411 may be the same as or different from the metal which forms the feed unit 410.

A first radiation subunit 401 is a metallic layer which extends upwards from the left end of the transverse arm and is formed on the insulating layer 407, and during the process of extending upwards to form the first radiation subunit 401, it may be extending upwards vertically and may also be extending upwards slightly to the left or to the right. The metal which forms the first radiation subunit 401 may be Cu or other metal, and the metal which forms the first radiation subunit 401 may be the same as or different from the metal which forms the feed unit 410.

A second radiation subunit 402 is a metallic layer which extends upwards from the right end of the transverse arm and is formed on the insulating layer 407. During the process of extending upwards to form the second radiation subunit 402, it may be extending upwards vertically and may also be extending upwards slightly to the left or to the right. The metal which forms the second radiation subunit 402 may be Cu or other metal, and the metal which forms the second radiation subunit 402 may be the same as or different from the metal which forms the feed unit 410.

A third radiation subunit 403 is a metallic layer which extends upwards from the middle of the transverse arm 411 and is formed on the insulating layer 407. During the process of extending upwards to form the third radiation subunit 403, it may be extending upwards vertically and may also be extending upwards slightly to the left or to the right. The metal which forms the third radiation subunit 403 may be Cu or other metal, and the metal which forms the third radiation subunit 403 may be the same as or different from the metal which forms the feed unit 410, and the width of the third radiation subunit 403 is greater than those of the first radiation subunit 401 and the second radiation subunit 402.

A fourth radiation subunit 404 is a metallic layer extending upwards between the second radiation subunit 402 and the third radiation subunit 403 from the transverse arm 411 and formed on the insulating layer 407. During the process of extending upwards to form the fourth radiation subunit 404, it may be extending upwards vertically and may also be extending upwards slightly to the left or to the right. The metal which forms the fourth radiation subunit 404 may be Cu or other metal, and the metal which forms the fourth radiation subunit 404 may be the same as or different from the metal which forms the feed unit 410. There is a first gap between the fourth radiation subunit 404 and the second radiation subunit 402. There is also a second gap between the fourth radiation subunit 404 and the third radiation subunit 403. The width of the first gap may be the same as or different from that of the second gap.

A fifth radiation subunit 405 is a metallic layer extending upwards between the first radiation subunit 401 and the third radiation subunit 403 from the transverse arm 411 and formed on the insulating layer 407. During the process of extending upwards to form the fifth radiation subunit 405, it may be extending upwards vertically and may also be extending upwards slightly to the left or to the right. The metal which forms the fifth radiation subunit 405 may be Cu or other metal, and the metal which forms the fifth radiation subunit 405 may be the same as or different from the metal which forms the feed unit 410. There is a third gap between the fifth radiation subunit 405 and the first radiation subunit 401, and there is also a fourth gap between the fifth radiation subunit 405 and the third radiation subunit 403. The width of the third gap may be the same as or different from that the width of the fourth gap.

The widths of the fourth radiation subunit 404 and the fifth radiation subunit 405 are smaller than those of the first radiation subunit 401 and the second radiation subunit 402.

A sixth radiation subunit 406 is at the top of the third radiation subunit 403. During the forming process, the top of the third radiation subunit 403 may be approximately connected to the middle of the lower edge of the six radiation subunit 406 and may also be connected to a position slightly to the left end or the right end on the lower edge of the sixth radiation subunit 406. The metal which forms the sixth radiation subunit 406 may be Cu or other metal, and the metal which forms the sixth radiation subunit 406 may be the same as or different from the metal which forms the feed unit 410. The width of the lower edge of the sixth radiation subunit 406 is greater than that of the top of the third radiation subunit 403.

The sixth radiation subunit 406, the first radiation subunit 401, the second radiation subunit 402 and the transverse arm 411 constitute a first radiation unit the area of which is the first area. The fourth radiation subunit 404, the fifth radiation subunit 405 and the transverse arm 411 constitute a second radiation unit the area of which is the second area. The third radiation subunit 403 forms a third radiation unit, the area of the third radiation unit is the third area, wherein the first area is greater than the second area, and the second area is greater than the third area.

During the operation of the printed circuit board, since the areas of the first, the second and the third areas are different, three kinds of signals in different frequency bands are radiated via the first, the second and the third radiation units, and in particular, the energy radiated by the first radiation unit is low-frequency energy, the frequency range thereof may be 870 MHz to 975 MHz, of course, low-frequency signals in other frequency band may also be radiated; the energy radiated by the second radiation unit is intermediate-frequency energy, the frequency range thereof may be 1.7 GHz to 2 GHz, of course, intermediate-frequency signals in other frequency band may also be radiated; the energy radiated by the third radiation unit is high-frequency energy, the frequency range thereof may be 2.2 GHz to 2.8 GHz, of course, high-frequency signals in other frequency band may also be radiated.

Of course, the low frequency, intermediate-frequency and high-frequency resonate frequencies in this embodiment 401 may be adjusted by adjusting the size of the gap between the fourth radiation subunit 404 and the second radiation subunit 402 and the size of the gap between fourth radiation subunit 404 and the third radiation subunit 403, and by adjusting the size of the gap between the fifth radiation subunit 405 and the first radiation subunit 401 and the size of the gap between the fifth radiation subunit 405 and the third radiation subunit 403; by adjusting the width of the feed unit 410 and the size and shape of the ground plane 408, the standing wave parameters and radiation direction of the antenna in embodiment of the disclosure may be adjusted.

Figure 5:
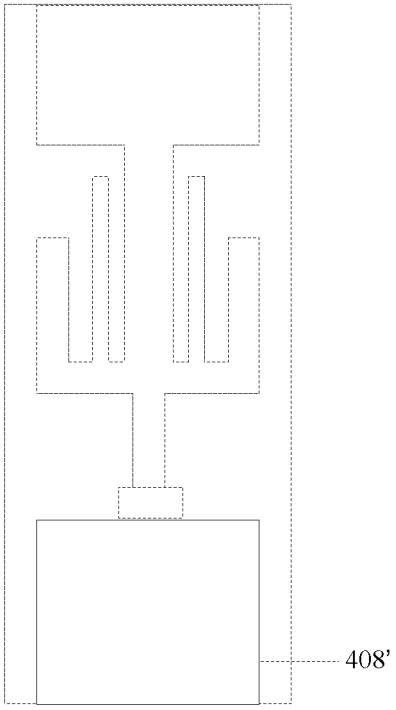
FIG. 5 is a structure diagram of a printed antenna in embodiment 5 of the disclosure.

Please refer to FIG. 5, it is a printed antenna provided in the fifth embodiment of the disclosure, and in the fifth embodiment, the shape of the ground plane 408' is different from that of the ground plane 408 in the fourth embodiment, and in the fourth embodiment, the two ends of the upper edge of the ground plane 408 also extend upwards to form two arms, but neither of these two arms is connected to the transverse arm 411, while in the fifth embodiment, the two ends of the upper edge of the ground plane 408' do not extend upwards to form two arms.

Figure 6:
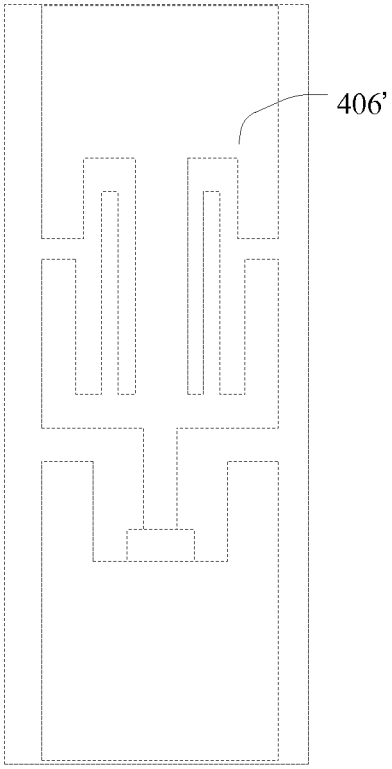
FIG. 6 is a structure diagram of a printed antenna in embodiment 6 of the disclosure.

Please refer to FIG. 6, it is a printed antenna provided in a sixth embodiment of the disclosure, in the sixth embodiment, the shape of the sixth radiation subunit 406' is different from that of the sixth radiation subunit 406 in the fourth embodiment, and in the sixth embodiment, the two ends of the lower edge of the sixth radiation subunit 406' also extend downwards to form two arms, but neither of these two arms is connected to the first radiation subunit 401, the second radiation subunit 402, the fourth radiation subunit 404 and the fifth radiation subunit 405.

Of course, for those skilled in the art to which the present application belongs, the printed antenna may have various changes and variations according to the actual demand; however, as long as the variations thereof may finally realize that the antenna in the printed circuit board may radiate signals in three different frequency bands and there is only one feed point, those amendments within the disclosure are all included in the scope of the protection of the disclosure.

On the other hand, an embodiment of the disclosure also provides mobile communication equipment, which comprises:

a data input device configured to provide a user with input data;

a data output device configured to output data to a user;

a PCB board comprising:

an insulating layer;

a ground plane, being a layer of metal formed on the insulating layer;

a feed unit, being multiple metallic lines formed on the insulating layer and comprising a first end and a second end;

a feed point, provided between the feed unit and the ground plane, and connected to the first end of the feed unit;

a first radiation unit, formed on the insulating layer, connected to the second end of the feed unit, and configured to radiate or receive first frequency band signals;

a second radiation unit, formed on the insulating layer, connected to the second end of the feed unit, and configured to radiate or receive second frequency band signals;

a third radiation unit, formed on the insulating layer, connected to the second end of the feed unit, and configured to radiate or receive third frequency band signals.

The structure of the PCB board in the mobile communication equipment is shown as FIG. 4, which is in particular as follows:

a ground plane 408 is a layer of metal formed on the insulating layer 407, wherein the metal may be Cu or Al and may also be other metal or metal alloy with a small resistance and strong anti-interference capability known to those skilled in the art.

A feed unit 410 is multiple metallic lines formed on the insulating layer 407, and the feed unit 410 includes a first end and a second end. The material of the feed unit 410 may be the same as or different from that of the ground plane 408; the ground plane 408 may be located together with the feed unit 410 on the same side of the PCB board and they may be located on either side of the PCB board respectively.

A feed point 409 is set between the feed unit 410 and the ground plane 408, the feed point 409 is connected to the first end of the feed unit 410, and the feed point 409 feeds each radiation subunit via the feed unit 410.

A transverse arm 411 is a metallic layer formed on the insulating layer 407, the second end of the feed unit 410 is connected to the transverse arm 411, the connection position is approximately in the middle of the transverse arm 411, and during practical application, those skilled in the art to which the present application belongs may also set the connection position to be close to the left end or the right end of the transverse arm 411 as required. The metal which forms the transverse arm 411 may be Cu or other metal, and the metal which forms the transverse arm 411 may be the same as or different from the metal which forms the feed unit 410.

a first radiation subunit 401 is a metallic layer extending upwards from the left end of the transverse arm 411 and formed on the insulating layer 407, and during the process of extending upwards to form the first radiation subunit 401, it may be extending upwards vertically and may also be extending upwards slightly to the left or to the right. The metal which forms the first radiation subunit 401 may be Cu or other metal, and the metal which forms the first radiation subunit 401 may be the same as or different from the metal which forms the feed unit 410.

A second radiation subunit 402 is a metallic layer extending upwards from the right end of the transverse arm 411 and formed on the insulating layer 407, and during the process of extending upwards to form the second radiation subunit 402, it may be extending upwards vertically and may also be extending upwards slightly to the left or to the right. The metal which forms the second radiation subunit 402 may be Cu or other metal, and the metal which forms the second radiation subunit 402 may be the same as or different from the metal which forms the feed unit 410.

A third radiation subunit 403 is a metallic layer extending upwards from the middle of the transverse arm 411 and formed on the insulating layer 407, and during the process of extending upwards to form the third radiation subunit 403, it may be extending upwards vertically and may also be extending upwards slightly to the left or to the right. The metal which forms the third radiation subunit 403 may be Cu or other metal, and the metal which forms the third radiation subunit 403 may be the same as or different from the metal which forms the feed unit 410, and the width of the third radiation subunit 403 is greater than those of the first radiation subunit 401 and the second radiation subunit 402.

A fourth radiation subunit 404 is a metallic layer extending upwards between the second radiation subunit 402 and the third radiation subunit 403 from the transverse arm 411 and formed on the insulating layer 407, and during the process of extending upwards to form the fourth radiation subunit 404, it may be extending upwards vertically and may also be extending upwards slightly to the left or to the right. The metal which forms the fourth radiation subunit 404 may be Cu or other metal, and the metal which forms the fourth radiation subunit 404 may be the same as or different from the metal which forms the feed unit 410. There is a first gap between the fourth radiation subunit 404 and the second radiation subunit 402, and there is also a second gap between the fourth radiation subunit 404 and the third radiation subunit 403, the width of the first gap may be the same as or different from that of the second gap.

A fifth radiation subunit 405 is a metallic layer extending upwards between the first radiation subunit 401 and the third radiation subunit 403 from the transverse arm 411 and formed on the insulating layer 407, and during the process of extending upwards to form the fifth radiation subunit 405, it may be extending upwards vertically and may also be extending upwards slightly to the left or to the right. The metal which forms the fifth radiation subunit 405 may be Cu or other metal, and the metal which forms the fifth radiation subunit 405 may be the same as or different from the metal which forms the feed unit 410. There is a third gap between the fifth radiation subunit 405 and the first radiation subunit 401, and there is also a fourth gap between the fifth radiation subunit 405 and the third radiation subunit 403, the width of the third gap may be the same as or different from that of the fourth gap.

The widths of the fourth radiation subunit 404 and the fifth radiation subunit 405 are smaller than those of the first radiation subunit 401 and the second radiation subunit 402.

A sixth radiation subunit 406 is formed at the top of the third radiation subunit 403. During the forming process, the top of the third radiation subunit 403 may be approximately connected to the middle of the lower edge of the six radiation subunit 6 and may also be connected to a position slightly to the left end or the right end on the lower edge of the sixth radiation subunit 406, and the metal which forms the sixth radiation subunit 406 may be Cu or other metal, and the metal which forms the sixth radiation subunit 406 may be the same as or different from the metal which forms the feed unit 410, and the width of the lower edge of the sixth radiation subunit 406 is greater than that of the top of the third radiation subunit 403.

The sixth radiation subunit 406, the first radiation subunit 401, the second radiation subunit 402 and the transverse arm 411 constitute a first radiation unit the area of which is the first area; the fourth radiation subunit 404, the fifth radiation subunit 405 and the transverse arm 411 constitute a second radiation unit the area of which is the second area; and the third radiation subunit 403 forms a third radiation unit, the area of the third radiation unit is the third area, wherein the first area is greater than the second area, and the second area is greater than the third area.

During the operation of the mobile communication equipment, since the areas of the first, the second and the third areas are different, three kinds of signals in different frequency bands are radiated via the first, the second and the third radiation units, and in particular, the energy radiated by the first radiation unit is low-frequency energy, the frequency range thereof may be 870 MHz to 975 MHz, of course, low-frequency signals in other frequency band may also be radiated; the energy radiated by the second radiation unit is intermediate-frequency energy, the frequency range thereof may be 1.7 GHz to 2 GHz, of course, intermediate-frequency signals in other frequency band may also be radiated; the energy radiated by the third radiation unit is high-frequency energy, the frequency range thereof may be 2.2 GHz to 2.8 GHz, of course, high-frequency signals in other frequency band may also be radiated.

Of course, the low frequency, intermediate-frequency and high-frequency resonate frequencies in this embodiment 401 may be adjusted by adjusting the size of the gap between the fourth radiation subunit 404 and the second radiation subunit 402 and the size of the gap between fourth radiation subunit 404 and the third radiation subunit 403, and adjusting the size of the gap between the fifth radiation subunit 405 and the first radiation subunit 401 and the size of the gap between the fifth radiation subunit 405 and the third radiation subunit 403; by adjusting the width of the feed unit 410 and the size and shape of the ground plane 408, the standing wave parameters and radiation direction of the antenna in the embodiment of the disclosure may be adjusted.

The antenna in the mobile communication equipment may be changed properly, as shown in FIGS. 2 and 3, for those skilled in the art to which the present application belongs, the printed antenna in the mobile communication equipment may have various changes and variations according to the actual demand; however, as long as the variations thereof may finally realize there are three different frequency bands and there is only one feed point, those amendments within the disclosure are all included in the scope of the protection of the disclosure.

Figure 7:
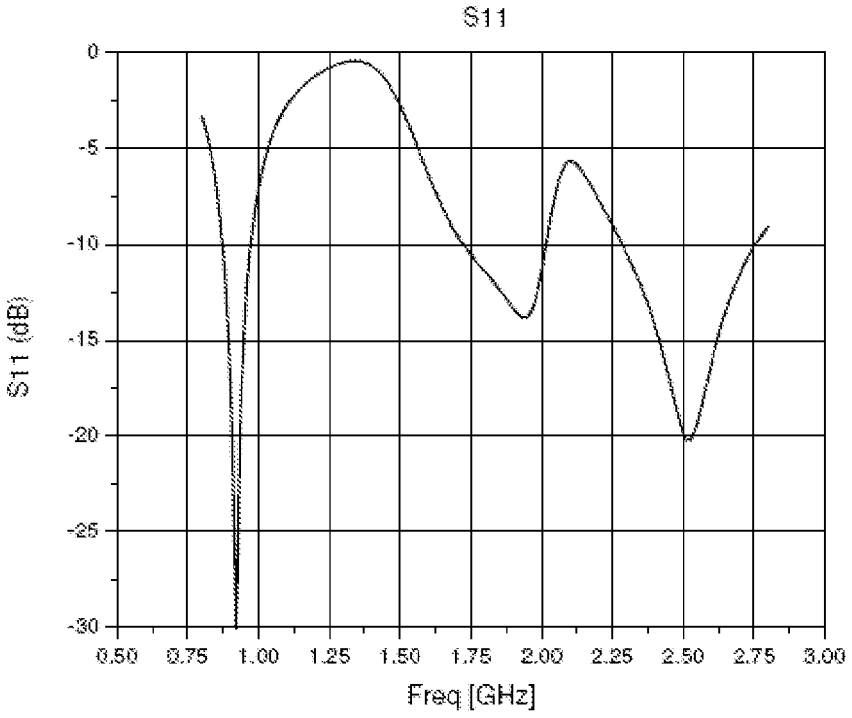
FIG. 7 is a relation diagram of echo loss versus frequency simulated by the printed antenna in embodiment 1 of the disclosure from frequency 0.50 GHz to 3.00 GHz.

Please refer to FIG. 7, FIG. 7 is a relation diagram of echo loss versus frequency from frequency 0.50 GHz to 3.00 GHz in embodiment 1 of the disclosure, and it may be seen from the figure that in the first frequency band (0.85 to 1.125) and the second frequency band (1.575 to 2.825), the echo loss values of the printed antenna in the disclosure are under −5 dB.

Figure 8:
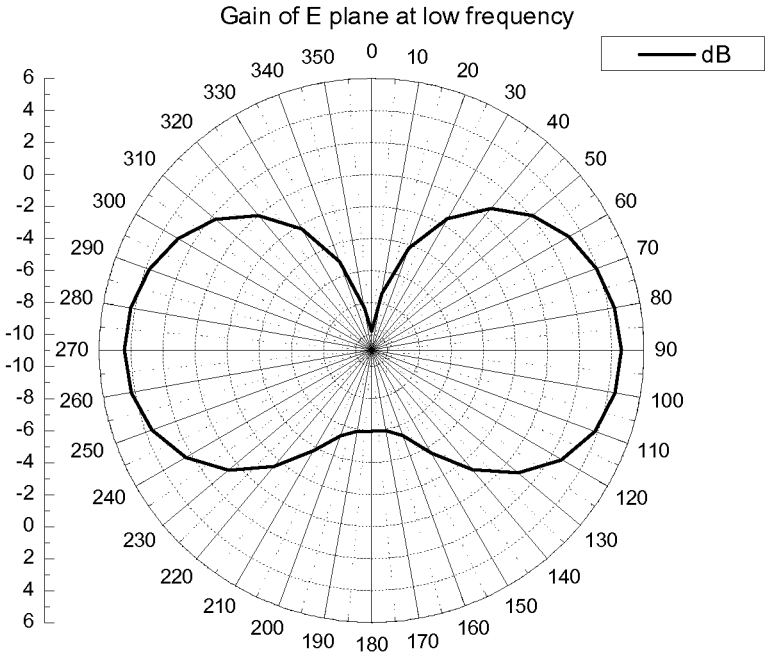
FIG. 8 is an E-plane directional diagram of testing with a low frequency simulated by the printed antenna in embodiment 1 of the disclosure.

Please refer to FIG. 8, FIG. 8 is an E-plane directional diagram of testing with a low frequency simulated in embodiment 1 of the disclosure, and it may be seen from the figure that the change range of the gain is (−3 to 0).

Figure 9:
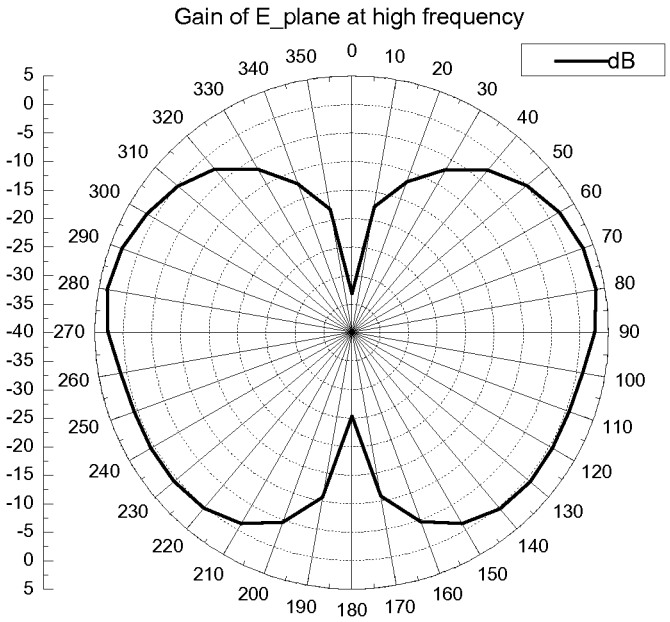
FIG. 9 is an E-plane directional diagram of testing with an intermediate frequency simulated by the printed antenna in embodiment 1 of the disclosure.

Please refer to FIG. 9, FIG. 9 is an E-plane directional diagram of testing with an intermediate frequency simulated in embodiment 1 of the disclosure, and it may be seen from the figure that the change range of the gain is (−40 to −17.5).

Figure 10:
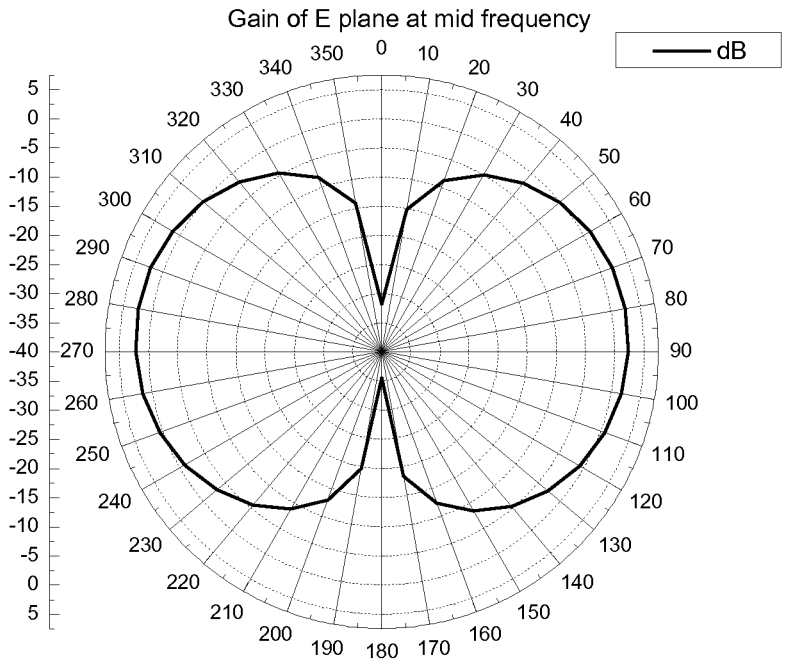
FIG. 10 is an E-plane directional diagram of testing with a high frequency simulated by the printed antenna in embodiment 1 of the disclosure.

Please refer to FIG. 10, FIG. 10 is an E-plane directional diagram of testing with a high frequency simulated in embodiment 1 of the disclosure, and it may be seen from the figure that the change range of the gain is (−40 to −10).

One or more technical solutions in the embodiments of the disclosure at least have the following technical effects:

Since the radiation units are completely embedded together, a single radiation source is formed. Only one feed point is needed to feed, and three kinds of frequencies may be radiated;

since there is only one feed point in the entire antenna, it still has the advantages that the structure is simple and the operation is convenient; and since there is only one feed point in the entire antenna, mutual interference between the feed points may be prevented, ensuring the transmission performance of the antenna.

Although preferred embodiments of the disclosure have been described, once having learnt the basic inventive concept, those skilled in the art may make additional change and modification on these embodiments. Therefore, the appended claims are intended to interpret preferred embodiments and all the changes and modifications which fall into the scope of the disclosure.

Apparently, those skilled in the art may make various modifications and variations to the disclosure without departing from the scope of the disclosure. Thus, if these modifications and variations of the disclosure belong to the scope of the claims of the disclosure and an equivalent technology thereof, then the disclosure is also intended to contain these modifications and variations.

What is claimed is:

1. A printed antenna provided on a Printed Circuit Board (PCB) with an insulating layer, wherein the printed antenna comprises:

a ground plane, being a layer of metal formed on the insulating layer;

a feed unit, being multiple metallic lines formed on the insulating layer and comprising a first end and a second end;

a feed point, provided between the feed unit and the ground plane, and connected to the first end of the feed unit;

a first radiation unit, formed on the insulating layer, connected to the second end of the feed unit, and configured to radiate or receive first frequency band signals;

a second radiation unit, formed on the insulating layer, connected to the second end of the feed unit, and configured to radiate or receive second frequency band signals;

a third radiation unit, formed on the insulating layer, connected to the second end of the feed unit, and configured to radiate or receive third frequency band signals;

wherein the first radiation unit comprises: a transverse arm, being a metallic layer formed on the insulating layer, and connected to the second end of the feed unit; a first radiation subunit, being a metallic layer which extends upwards from the left end of the transverse arm and is formed on the insulating layer; a second radiation subunit, being a metallic layer which extends upwards from the right end of the transverse arm and is formed on the insulating layer; a third radiation subunit, being a metallic layer which extends upwards from the middle of the transverse arm and is formed on the insulating layer, the width of the third radiation subunit being greater than the widths of the first and the second radiation subunits; a fourth radiation subunit, being a metallic layer which extends upwards from the transverse arm between the second radiation subunit and the third radiation subunit and is formed on the insulating layer, there being a respective gap between the fourth radiation subunit and the second and the third radiation subunits; a fifth radiation subunit, being a metallic layer which extends upwards from the transverse arm between the first radiation subunit and the third radiation subunit and is formed on the insulating layer, there being a respective gap between the fifth radiation subunit and the first and the third radiation subunits, wherein the widths of the fourth and the fifth radiation subunits are smaller than the widths of the first and the second radiation subunits; a sixth radiation subunit, formed on the top of the third radiation subunit, the width of the sixth radiation subunit being greater than the width of the third radiation subunit.

2. The printed antenna as claimed in claim 1, wherein a first area of the first radiation unit is greater than a second area of the second radiation unit and the second area is greater than a third area of the third radiation unit.

3. The printed antenna as claimed in claim 1, wherein a first area is composed of areas of the sixth, the first and the second radiation subunits and the transverse arm.

4. The printed antenna as claimed in claim 1, wherein the second radiation unit comprises:

the fourth and fifth radiation subunits; a second area being composed of areas of the fourth and the fifth radiation subunits and the transverse arm.

5. The printed antenna as claimed in claim 1, wherein the third radiation unit is a third radiation subunit, a third area being an area of the third radiation subunit.

6. A mobile communication equipment, comprising: a data input device configured to provide a user with input data; a data output device configured to output data to a user; wherein the equipment further comprises: a Printed Circuit Board (PCB), the PCB comprising:

an insulating layer;

a ground plane, being a layer of metal formed on the insulating layer;

a feed unit, being multiple metallic lines formed on the insulating layer and comprising a first end and a second end;

a feed point, provided between the feed unit and the ground plane, and connected to the first end of the feed unit;

a first radiation unit, formed on the insulating layer, connected to the second end of the feed unit, and configured to radiate or receive first frequency band signals;

a second radiation unit, formed on the insulating layer, connected to the second end of the feed unit, and configured to radiate or receive second frequency band signals;

a third radiation unit, formed on the insulating layer, connected to the second end of the feed unit, and configured to radiate or receive third frequency band signals;

wherein the first radiation unit comprises: a transverse arm, being a metallic layer formed on the insulating layer, and connected to the second end of the feed unit; a first radiation subunit, being a metallic layer which extends upwards from the left end of the transverse arm and is formed on the insulating layer; a second radiation subunit, being a metallic layer which extends upwards from the right end of the transverse arm and is formed on the insulating layer; a third radiation subunit, being a metallic layer which extends upwards from the middle of the transverse arm and is formed on the insulating layer, the width of the third radiation subunit being greater than the widths of the first and the second radiation subunits; a fourth radiation subunit, being a metallic layer which extends upwards from the transverse arm between the second radiation subunit and the third radiation subunit and is formed on the insulating layer, there being a respective gap between the fourth radiation subunit and the second and the third radiation subunits; a fifth radiation subunit, being a metallic layer which extends upwards from the transverse arm between the first radiation subunit and the third radiation subunit and is formed on the insulating layer, there being a respective gap between the fifth radiation subunit and the first and the third radiation subunits, wherein the widths of the fourth and the fifth radiation subunits are smaller than the widths of the first and the second radiation subunits; a sixth radiation subunit, formed on the top of the third radiation subunit, the width of the sixth radiation subunit being greater than the width of the third radiation subunit.

7. The mobile communication equipment as claimed in claim 6, wherein a first area of the first radiation unit is greater than a second area of the second radiation unit and the second area is greater than a third area of the third radiation unit.

8. A printed antenna provided on a Printed Circuit Board (PCB) with an insulating layer, wherein the printed antenna comprises:

a ground plane, being a layer of metal formed on the insulating layer;

a feed unit, being multiple metallic lines formed on the insulating layer and comprising a first end and a second end;

a feed point, provided between the feed unit and the ground plane, and connected to the first end of the feed unit;

a first radiation unit, formed on the insulating layer, connected to the second end of the feed unit, and configured to radiate or receive first frequency band signals, wherein the first radiation unit comprises:

a transverse arm, being a metallic layer formed on the insulating layer, and connected to the second end of the feed unit;

a first radiation subunit, being a metallic layer which extends upwards from the left end of the transverse arm and is formed on the insulating layer;

a second radiation subunit, being a metallic layer which extends upwards from the right end of the transverse arm and is formed on the insulating layer;

a sixth radiation subunit, formed on the top of a third radiation subunit, the width of the sixth radiation subunit being greater than the width of the third radiation subunit.

9. The printed antenna as claimed in claim 8, wherein the printed antenna further comprises:

a second radiation unit, formed on the insulating layer, connected to the second end of the feed unit, and configured to radiate or receive second frequency band signals;

a third radiation unit, formed on the insulating layer, connected to the second end of the feed unit, and configured to radiate or receive third frequency band signals.

10. The printed antenna as claimed in claim 9, wherein a first area of the first radiation unit is greater than a second area of the second radiation unit and the second area is greater than a third area of the third radiation unit.

11. The printed antenna as claimed in claim 9, wherein the second radiation unit comprises:

the transverse arm;

a fourth radiation subunit, being a metallic layer which extends upwards from the transverse arm between the second radiation subunit and the third radiation subunit and is formed on the insulating layer, there being a respective gap between the fourth radiation subunit and the second and the third radiation subunits;

a fifth radiation subunit, being a metallic layer which extends upwards from the transverse arm between the first radiation subunit and the third radiation subunit and is formed on the insulating layer, there being a respective gap between the fifth radiation subunit and the first and the third radiation subunits, wherein the widths of the fourth and the fifth radiation subunits are smaller than the widths of the first and the second radiation subunits.

12. The printed antenna as claimed in claim 9, wherein the third radiation unit is:

the third radiation subunit, wherein the third radiation subunit is a metallic layer which extends upwards from the middle of the transverse arm and is formed on the insulating layer, the width of the third radiation subunit being greater than the widths of the first and the second radiation subunits.

* * * * *